United States Patent [19]

Holl

[11] Patent Number: 4,517,221

[45] Date of Patent: May 14, 1985

[54] ARRANGEMENT IN PRINTING MACHINES HAVING A VARNISHING UNIT FOR VARNISHING PRINTED SHEETS

[75] Inventor: Roland Holl, Weiterstadt, Fed. Rep. of Germany

[73] Assignee: M.A.N.-ROLAND Druckmaschinen Aktiengesellschaft, Fed. Rep. of Germany

[21] Appl. No.: 596,004

[22] Filed: Apr. 2, 1984

[30] Foreign Application Priority Data

Apr. 2, 1983 [DE] Fed. Rep. of Germany ..... 3312128

[51] Int. Cl.[3] ..... B41F 5/16; B41F 5/18

[52] U.S. Cl. ..... 427/8; 101/184; 118/663

[58] Field of Search ..... 101/184; 118/663; 427/8

[56] References Cited

U.S. PATENT DOCUMENTS 3,473,468 10/1969 Vandeman et al. ..... 101/184 X 4,423,677 1/1984 Fischer ..... 101/184 X

FOREIGN PATENT DOCUMENTS 971399 9/1964 Fed. Rep. of Germany ..... 101/184

*Primary Examiner*—Michael R. Lusignan

*Attorney, Agent, or Firm*—Leydig, Voit, Osann, Mayer & Holt, Ltd.

[57] ABSTRACT

In response to a stop command such as a printing disturbance signal, the transfer of varnish to the varnish applicator roller is shut off but the feeding of sheets through the varnishing unit is not immediately shut off; rather, a few remaining sheets are thereafter fed through the varnishing unit before the varnish applicator roller is thrown off from the cooperating cylinder and the machine drive is shut off. The few remaining sheets remove the residual varnish from the varnish applicator roller so that when printing is resumed the newly printed sheets do not stick to the varnish applicator roller or the cooperating cylinder. In a preferred embodiment a preselection counter, clocked by sheet feed cycles, determines the number of remaining sheets.

12 Claims, 7 Drawing Figures

ARRANGEMENT IN PRINTING MACHINES HAVING A VARNISHING UNIT FOR VARNISHING PRINTED SHEETS

FIELD OF THE INVENTION

The present invention relates to sheet-fed printing machines having varnishing units for applying varnish to the printed sheets.

BACKGROUND OF THE INVENTION

In printing machines which varnish the printed sheets after printing, there is a risk that if printing is interrupted or shut down the varnish liquid remaining on the machine parts which apply varnish to the printed sheets may rapidly stick or dry on these machine parts. Whenever printing is interrupted, this dried varnish must be cleaned or washed from these machine parts.

In some printing machines, such as the machine disclosed in West German Pat. No. 2,608,661, sheets are overprinted, varnished and dried in one gripper operation. In such a machine the varnish feed unit is on the plate cylinder and the varnished sheet passes through a dryer in the same gripper operation. In such a machine, when printing is interrupted, the varnish on the varnishing roller train to the plate cylinder dries fairly rapidly. The dryer heat greatly accelerates the drying process, so that sheets may become stuck to the varnishing rollers even after brief interruptions in continuous printing.

SUMMARY OF THE INVENTION

The primary object of the present invention is to prevent printed sheets from sticking to the varnish applicator roller and its cooperating cylinder in a varnishing unit when continuous printing is resumed after an interruption in the printing process.

Specifically, an object of the invention is to reduce or substantially eliminate the residual film of varnish left on the varnishing rollers when continuous printing is interrupted, so that when printing resumes the printed sheets do not stick to the varnishing rollers.

Another object of the invention is to eliminate the need to clean or wash varnishing rollers after an interruption in continuous printing.

Still another object of the invention is to reduce the down time of the printing machine caused by paper jamming or required during cleaning of the varnishing rollers.

Briefly, according to the invention, in the event a printing disturbance signal indicates that continuous printing must be interrupted, the supply of varnish in the varnishing unit is disconnected from the varnishing rollers, but the sheet feed is not stopped at this time. Rather, the sheet feed continues to feed a preselected number of sheets before the sheet feed is shut off. Feeding of the preselected number of sheets virtually eliminates the residual varnish film on the varnishing rollers such that when printing resumes the newly printed sheets do not stick to the varnishing rollers. Preferably, the preselected number of sheets is counted by a digital electronic counter and the number of sheets is selected to be at least three. Preferably, after the preselected number of sheets are counted, the varnish applicator roller is pneumatically thrown off from its cooperating cylinder. The printing disturbance signal indicates, for example, that the paper feeder is unable to supply sheets to be printed, or the sheet delivery unit cannot receive the printed sheets.

BRIEF DESCRIPTION OF THE DRAWINGS

Other objects and advantages of the invention will become apparent upon inspection of the drawings, wherein.

While the invention has been described in connection with a preferred embodiment, it will be understood that the intention is not to be limited to the particular forms of the invention which have been shown, but the intention is, on the contrary, to cover the various alternative and equivalent constructions included within the spirit and scope of the appended claims.

DESCRIPTION OF A PREFERRED EMBODIMENT

Figure 1:
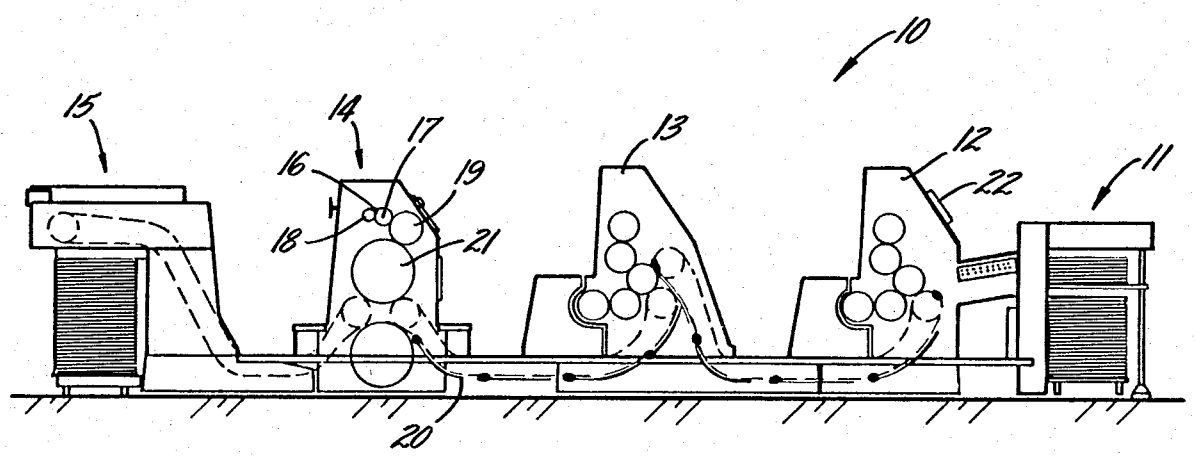
FIG. 1 is a multi-color printing machine having a varnishing system according to the present invention.

Turning now to the drawings, there is shown in FIG. 1 a multi-color printing machine generally designated 10 having a supply of sheets in a paper feeder generally designated 11 which are successively fed to two two-color printing units 12 and 13. After printing, the sheets are varnished by a varnishing unit generally designated 14 and the varnished sheets are deposited in a sheet delivery unit generally designated 15.

Occasionally, a printing disturbance occurs in the printing machine 10 which requires the interruption of continuous printing. A printing disturbance may be caused, for example, by the paper feeder 11 becoming empty or unable to feed because of a misaligned sheet entering the first printing unit 12, or due to a failure of the sheet delivery unit 15 to be emptied. In known printing system, these printing disturbances are indicated by appropriate sensors and in response the paper feed through the machine is shut off.

It has been found that the interruption of continuous printing caused by a printing disturbance may result in difficulties in the varnishing unit 14 when continuous printing resumes. In order to apply a coat of varnish to the printed sheets, the varnishing unit 14 includes a varnishing resevoir 16, a transfer roller 17, and a metering roller 18. The transfer roller 17 conveys a regulated supply of the varnish to a varnish applicator roller 19, which then transfers the varnish to the printed sheets 20 conveyed by a cooperating cylinder 21 toward the sheet deliver unit 15. It has been found with this arrangement that when continuous printing is interrupted by a printing disturbance, newly printed sheets may become stuck to the varnish applicator roller 19 or the cooperating cylinder 21 when continuous printing resumes.

In accordance with an important aspect of the invention, when a printing disturbance occurs, the transfer of varnish from the supply 16 to the varnish applicator roller 19 is shut off, but the feed of printed sheets 20 to receive varnish from the varnish applicator roller 19 is not immediately shut off; rather, the feeding of the sheets 20 is not shut off until a sufficient number of sheets 20 are fed in order to substantially remove the residual varnish on the applicator roller 19. Experience has shown that about three printed sheets 20 are sufficient to remove the residual varnish on the varnish applicator roller 19 to such an extent that the sheets printed at the beginning of the resumption of continuous printing do not stick to the roller 19 or cylinder 21. Moreover, any residual varnish left on the roller 19 when continuous printing resumes has such a thin film thickness that the fresh varnish rapidly desolves the residual film when printing restarts. Therefore, it is not necessary to wash the varnishing unit 14 after short standstill periods, and the down time for the multi-color printing machine 10 is consequently reduced.

In accordance with another aspect of the present invention, the number of printed sheets 20 to be fed after a printing disturbance but before stopping the feeding of sheets is selected by the printing machine operator and the preselected number of sheets is counted by a preselection counter 22 (located at the first printing unit 12). The preselection counter 22 has associated control circuitry, described further in conjunction with FIG. 7, which provides a clocking signal to the preselection counter 22 and presets the preselection counter to the preselected number of sheets upon the occurrence of the printing disturbance. Also upon occurrence of the printing disturbance, the supply of varnish to the varnish applicator roller 19 is shut off so that the sheets 20 being fed to receive varnish after the printing disturbance clean the varnish applicator roller 19. During the time that these remaining sheets 20 are cleaning the varnish applicator roller 19, the preselection counter 22 counts down once for each remaining sheet 20 being fed, until the preselection counter 20 registers a value of zero, at which time the feeding of sheets 20 is discontinued. In other words, when the preselection counter 22 counts down to zero, the preselected number of remaining sheets 20 have cleaned the varnish applicator roller 19 and then the printing machine 10 is shut down to permit the machine operator to correct the printing disturbance.

Figure 2:
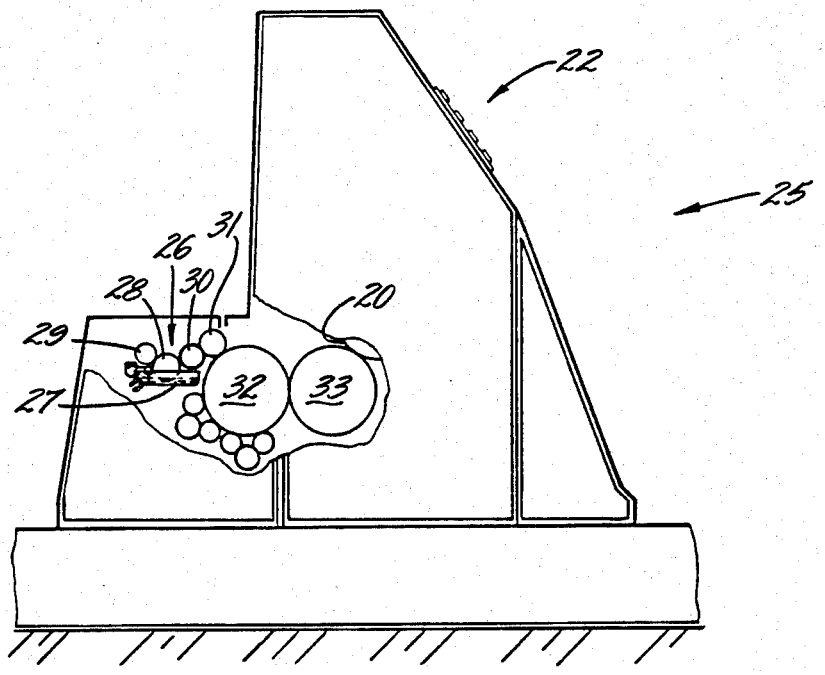
FIG. 2 shows a printing unit with a convertible dampening or varnishing unit.

Turning now to FIG. 2, there is shown a second kind of printing unit generally designated 25 which includes a convertible dampening or varnishing unit generally designated 26. The varnishing unit 26 comprises a varnish fountain or tank 27, a fountain roller 28, a metering roller 29, a transfer roller 30, and a varnish applicator roller 31 which cooperates with a cylinder 32. For the varnishing operation, the varnish is transferred from the cylinder 32 to a rubber cylinder 33. Use of the present invention in the printing unit 25 has been found very advantageous, since it was always very difficult to clean the rubber cylinder 33 when dispersion varnishes were used. Shut down of the varnish transfer to the varnish applicator roller 31 is accomplished by pivoting the fountain roller 28 away from the transfer roller 30 in response to a printing disturbance signal. After the preselection counter 22 passes a preselected number of remaining sheets to clean the rubber cylinder 33 and hence the cooperating cylinder 32 and applicator roller 31, the applicator roller is thrown off the cooperating cylinder and the sheet feed is shut off.

Figure 3:
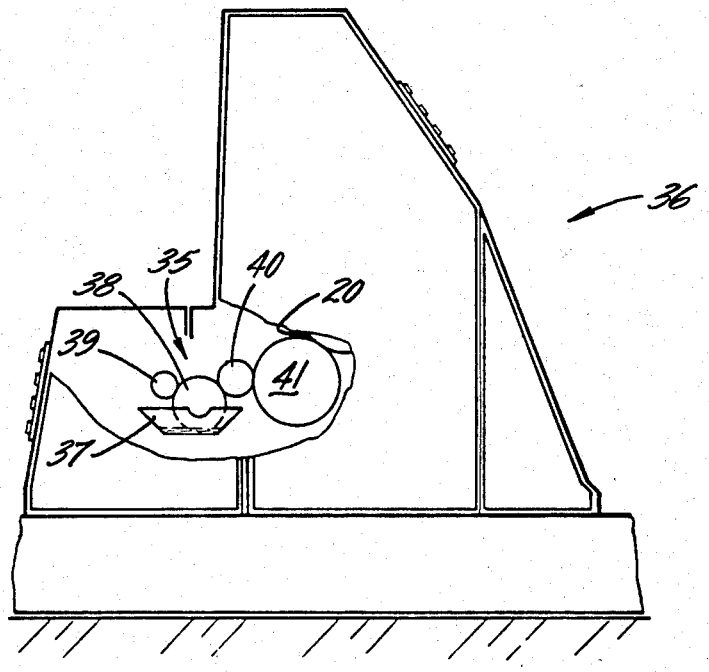
FIG. 3 shows a printing unit with a special varnishing unit.

FIG. 3 shows a third kind of varnishing unit 35 in another printing unit generally designated 36. The varnishing unit 35 includes a varnish tank or fountain 37, a fountain roller 38, a metering roller 39, and a varnish applicator roller 40. The applicator roller 40 transfers varnish to a cooperating cylinder 41 having a rubber blanket. Full-area or recessed varnishing can be carried out with the cylinder 41. In this case the printing unit 36 is the last unit of a multi-color printing machine and is controlled from the preselection counter 22 of the first printing unit 12 in the fashion shown in FIG. 1.

In response to a printing disturbance, a pneumatic disconnection device pivots the varnishing fountain roller 38 away from the varnish applicator roller 40. Depending on the adjustment of the preselection counter 22 at the first printing unit 12 (in the fashion as shown in FIG. 1), the preselected number of printed sheets 20 are taken past the cylinder 41 after the varnishing fountain roller 38 has been pivoted away from the varnish applicator roller 40.

The preselection counter 22 is manually adjusted to count a preselected number of sheets depending upon the circumstances. The factors which the printing machine operator should consider when selecting the number of sheets include the size of the varnished transfer area, the viscosity of the varnish and the number of rollers required and engaged for the varnishing operation. Thus, the number to select depends upon experience and simple trial and error. It should be noted, however, that the range of selections is not great since the preferred number of sheets is about three in most cases.

Figure 4:
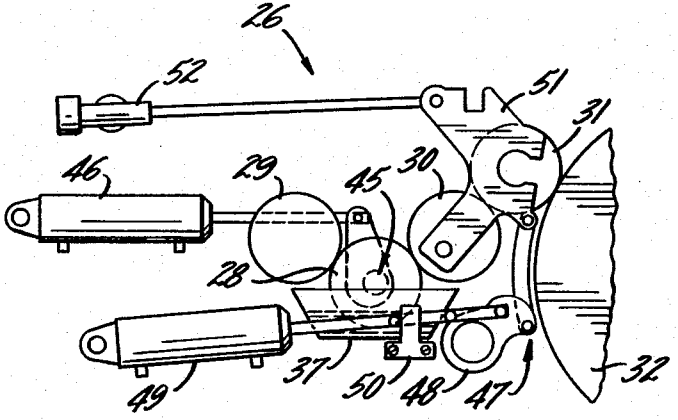
FIG. 4 is a detail of the convertible dampening or varnishing unit shown in FIG. 2 for the case of continuous printing.
Figure 5:
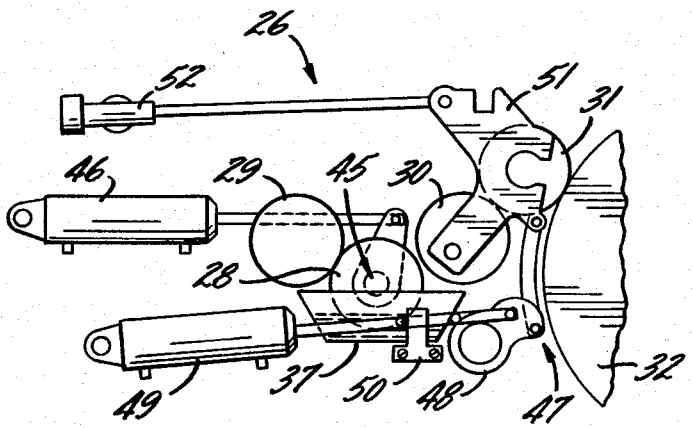
FIG. 5 is a detail of the convertible dampening or varnishing unit of FIG. 2 with the varnish applicator roller disconnected from the supply of varnish in response to a printing disturbance signal and during the time that a preselection counter is counting fed sheets.
Figure 6:
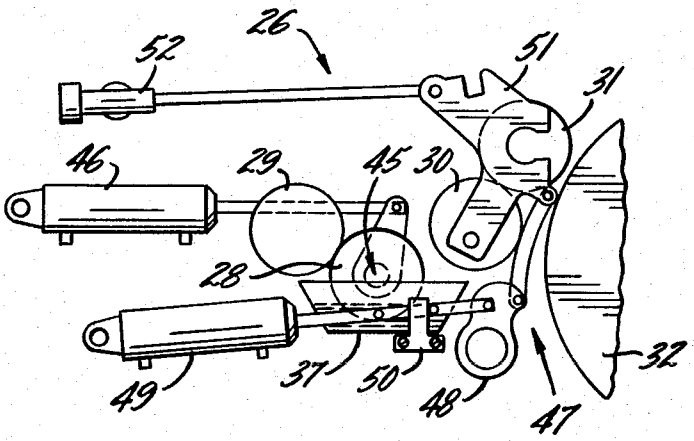
FIG. 6 is a detail of the convertible dampening or varnishing unit of FIG. 2 shown with the supply of varnish disconnected from the varnishing applicator roller and the varnishing applicator roller being thrown off its cooperating cylinder in response to the preselection counter having counted a preselected number of sheets fed after the printing disturbance signal.

Shown in FIGS. 4–6 are various positions of pneumatic actuators and associated linkages to control the varnishing unit 26 used in the printing unit 25 of FIG. 2. The varnishing fountain roller 28 is mounted to the machine frame (not shown) via an eccentric mount generally designated 45 and the eccentric is rotatable by a pneumatic actuator 46 to throw off the fountain roller 28 from the transfer roller 30, which is presumed to be journaled to the machine frame (not shown). The varnish applicator roller 31 is adapted to be thrown off of the cooperating cylinder 32 via a linkage generally designated 47 including a pivot 48, a cooperating pneumatic actuator 49 and limit stop 50, a pivoted arm 51 to which the applicator roller 31 is journaled, and an adjustable stop 52 for setting the impression force of the varnish applicator roller 31 when the applicator 31 is engaged with the cooperating cylinder 32.

FIG. 4 shows the positions of the varnish fountain roller 28 and the varnish applicator roller 31 for the case of continuous printing. When a printing disturbance occurs requiring the shut down of the printing machine, the control system shown and described below in conjunction with FIG. 7 actuates the pneumatic actuator 46 to rotate the eccentric in the eccentric mount 45 thereby throwing off the fountain roller 28 from the transfer roller 30. During this time the preselected number of remaining sheets are counted by the preselection counter 22. Once the preselected number of sheets have been fed to reduce or virtually eliminate the residual varnish on the varnish applicator roller 31, the transfer roller 30 and the cooperating cylinder 32, the control system actuates the pneumatic actuator 49 to throw off the applicator roller 31 from the cooperating cylinder 32 as shown in FIG. 6. At this time, the sheet feed is also turned off.

Figure 7:
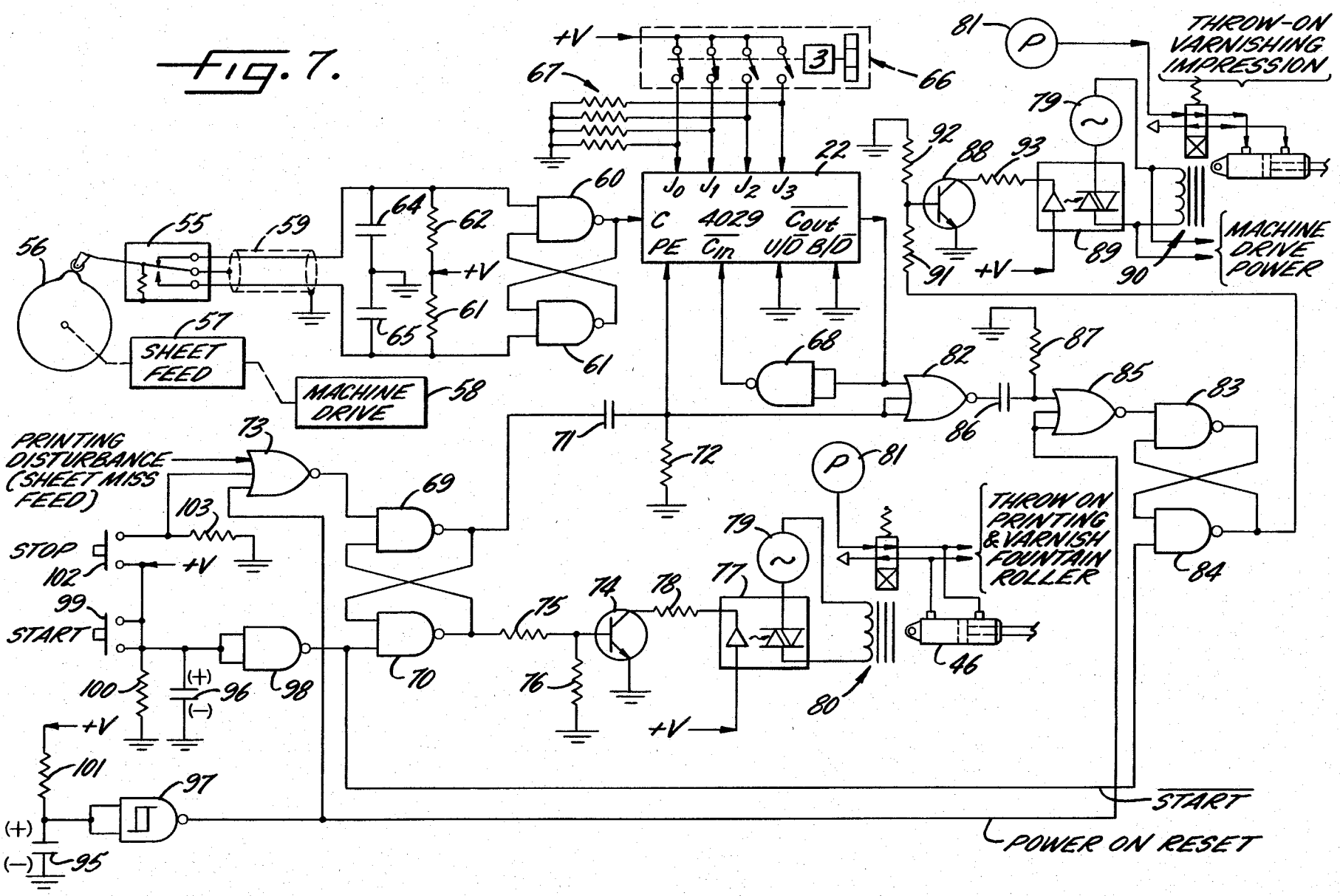
FIG. 7 is a circuit diagram of a specific preselection counter and its associated control logic.

The associated control circuitry for the preselection counter 22 is shown in FIG. 7. In order to count the number of remaining sheets 20 fed to the varnishing unit 26, a microswitch 55 senses the passage of sheets, for example, by being activated by a cam 56 in the sheet feed 57 which is mechanically driven by the machine drive 58 for the printing unit 25 (FIG. 2). Signals from the microswitch 55 are conveyed via a shielded cable 59 to a bounce eliminator comprising a set-reset flip-flop using NAND gates 60 and 61. The NAND gates are, for example, Part No. 4011. Pull up resistors 62 and 63 connected to positive supply (+V) provide the logical high signals to the contacts of the microswitch 55. A pair of capacitors 64 and 65 provide noise rejection. The output of the NAND gate 60 is applied to the clock input (C) of the preselection counter 22.

The preselection counter 22 is a synchronous up/-down counter (Part No. 4029) which may be asynchronously preset to a desired hexadecimal number applied to binary jam inputs $J_0$, $J_1$, $J_2$, and $J_3$. To permit the machine operator to enter the desired number of remaining sheets to be fed after a printing disturbance and after interruption of the supply of varnish to the varnish applicator roller 31, a decimal or hexadecimal thumbwheel switch generally designated 66 generates the corresponding binary signals impressed on the jam inputs $J_0$, $J_1$, $J_2$, and $J_3$. The thumbwheel switch 66 is excited by plus positive supply (+V) and the low logic level is established by pull down resistors generally designated 67. The binary/decimal ($B/\overline{D}$) input of the preselection counter 22 is grounded indicating that the thumbwheel switch 66 is a decimal switch rather than a hexadecimal switch.

The preselection counter 22 has its up/down input ($U/\overline{D}$) grounded indicating that the counter counts down for every clock cycle on the clock input (C) so long as the carry input ($\overline{C_{in}}$) active low, is active. A NAND gate 68 asserts the complement of the carry out ($\overline{C_{out}}$) active low onto the carry in ($\overline{C_{in}}$) so that the preselection counter 22 counts down until a count of zero is reached. At this point, the preselection counter 22 stops counting. It does not start counting again until an asynchronous preset pulse on the preset enable input (PE) presets the counter to the state selected by the thumbwheel switch 66. For the selection of three remainder sheets as shown in FIG. 7, the preset enable pulse sets the counter 22 to the binary state of three, and the carry out output ($\overline{C_{out}}$) simultaneously goes high, indicating that the state of the counter is unequal to zero. Then the counter decrements once for each clock cycle or once for each revolution of the cam 56, until the state of zero is reached. Once the state of zero is reached, the carry out ($C_{out}$) goes low, thereby setting the carry in ($\overline{C_{in}}$) to one, so that the counter 22 waits in the zero state until another preset enable pulse occurs.

The preset enable pulse occurs simultaneously with the sensing of a printing disturbance and the throw off of the varnish fountain roller 28 by the actuator 46 (FIGS. 4 and 5). The occurrance of a printing disturbance, in other words, changes the state of the control circuit in FIG. 7. To indicate whether the control system is in the continuous printing state before a printing disturbance, or in a state after the printing disturbance, a set-reset flip-flop comprising NAND gates 69 and 70 registers the continuous printing state. The preset enable pulse to the preselection counter 22 is generated by the change in the continuous printing state using a capacitor 71 and resistor 72. The resistor 72 shunts the preset enable (PE) to ground so that the counter 22 is not preset unless the output of the NAND gate 69 switches from a low to high logic state. This occurs in response to a printing disturbance signal received on a NOR gate 73 (Part No. 4025). The printing disturbance signal, for example, is provided by a sensor at the paper feeder 21 (FIG. 1) indicating a miss feed, misaligned or jammed sheet entering the first printing unit 4.

In order to control the impression of the first printing unit 12 and to throw on the varnish fountain roller 28 during continuous printing, the output of the NAND gate 70 indicates whether continuous printing is to occur. A logic high from the NAND gate 70 turns on a transistor 74 via a series current limiting resistor 75 and a shunt resistor 76. The transistor 74 drives a solid-state relay 77 through a current limiting resistor 78. The solid state relay 77 in turn closes a circuit between an alternating voltage supply 79, such as conventional line power or from a step down transformer, to drive a solenoid powered pneumatic valve generally designated 80. The pneumatic valve 80 connects a source of pneumatic pressure 81 to either side of the pneumatic cylinder 46, which is shown to be double acting, in order to throw on the varnish fountain roller 28 (FIG. 4). Thus, in response to a printing disturbance signal, the set-reset flip-flop comprising NAND gates 69 and 70 is reset to de-energize the solenoid valve 80 to thereby throw off printing impression and the varnish fountain roller 31.

Simultaneous with the throw off of printing impression and throw off of the varnishing fountain roller 28, the preselection counter 22 is preset to the selected initial state and counts down to count the selected number of remaining sheets. Once the carry out ($\overline{C_{out}}$) goes to a logic high (or at the end of the preset enable pulse in the case of zero sheets being selected), a NOR gate 82 goes high, indicating that the time delay is over and the sheet feed should be turned off and the varnishing impression should also be thrown off.

When the varnishing impression should be thrown off and the machine drive power or sheet feeder should be turned off defines another state of the control system. To indicate this state, another set-reset flip-flop is provided comprising NAND gates 83 and 84. This flip-flop is reset by the NOR gate 82 going high activating a NOR gate 85 through a pulse forming network comprising a series capacitor 86 and a shunt resistor 87 to ground.

The varnishing impression is thrown on and off and the machine drive power is turned on and off by means of a transistor 88, solid-state relay 89, and solenoid valve 90. The transistor 88 is driven by the NAND gate 84 through a series resistor 91 and shunt resistor 92. The transistor 88 drives the solid-state relay 89 through a current limiting resistor 93. The solid-state relay 89 in turn completes a circuit between the alternating voltage source 79 and the solenoid valve 90 to connect the source of pneumatic pressure 81 to the pneumatic actuator 49 for throwing on or off the varnish applicator roller 31. The solid-state relay 89 also supplies machine drive power to the machine drive 58 and consequently turns on and off the sheet feed 57.

As described above, it was assumed that the states of the set-reset flip-flops determining the throw on of the printing and varnish fountain roller and the throw on of the varnish impression and machine drive power correctly reflected the desired states of the printing unit 25. In particular it was assumed that the control system was in an initial state corresponding to continuous printing shown in FIG. 4. In other words, it was assumed that the NAND gate 70 had a logic high output and the NAND gate 84 also had a logic high input. When power is first applied to the control circuit, however, the printing unit 25 should be in an inactive or stopped state corresponding to FIG. 6 and should not enter the continuous printing state of FIG. 4 until the control system receives a start command from the machine operator.

In order to put the control circuit of FIG. 7 into an initial inactive state, a "power on" condition must be sensed. To sense this condition, capacitors 95 and 96 have their negative terminals connected to ground and are in a discharged state when power is first applied. The voltages on the capacitors are converted to logic states by NAND Schmitt triggers 97 and 98, respectively, (Part No. 4093) in order to generate a $\overline{\text{START}}$ and a POWER ON RESET signal. The $\overline{\text{START}}$ signal is supplied to NAND gates 70 and 84 and the POWER ON RESET signal is applied to NOR gates 73 and 85. Hence, when power is first applied to the control circuit of FIG. 4, the NAND gates 70 and 84 have logic low outputs thereby turning off the solid-state relays 77 and 89 and the solenoid valves 80 and 90 to thereby insure that the machine drive power is turned off and the printing, varnish fountain roller, and varnishing impression are thrown off as shown in FIG. 6.

To bring the printing unit 25 to the continuous printing state shown in FIG. 4, a manual start switch 99 is provided to charge the capacitor 96 from the positive supply voltage (+V). The capacitor 96 is normally discharged by a resistor 100. In contrast, after the power on reset condition the capacitor 95 is charged to a logic high state through a resistor 101. Thus, after the capacitor 95 is charged to logic high, the control circuit in FIG. 7 is ready to accept a start command from the operator signalled by closure of the start switch 99. Closure of the start switch 99 asserts a logic low on the $\overline{\text{START}}$ line to thereby put NAND gates 70 and 84 in a logic high state to turn on the solid-state relays 77 and 89 and thereby energize the solenoid valves 80 and 90 to throw on printing impression and the varnish fountain roller 28, and also to throw on varnishing impression and turn on the machine drive.

It should be noted that the time constant of the capacitor 96 and the resistor 100 is selected to be sufficiently large to normally clear any printing disturbances and to ensure that the preselection counter 22 will count down to zero from any initial state. Note that for the preselection counter 22 being selected as a decimal counter through the grounding of the $B/\overline{D}$ input, the preselection counter 22 will cycle to its zero state after at most the feeding of nine sheets.

To complement the manual start function provided by the switch 99, a manual stop switch 102 is provided to simulate a printing disturbance to thereby discontinue printing in accordance with the method of the invention. A shunt resistor 103 to ground ensures that the signal from the stop switch 102 to the NOR gate 73 is normally low unless the stop switch 102 completes a circuit to the positive supply voltage (+V).

In view of the above, a control system and control method for a varnishing unit in a printing machine has been disclosed which eliminates the need to clean or wash varnishing rollers after an interruption in continuous printing. In response to a stop command such as a printing disturbance signal, the transfer of varnish to the varnish applicator roller is shut off but the feeding of sheets through the varnishing unit is not immediately shut off; rather, a few remaining sheets are thereafter fed to the varnishing unit before the varnish applicator roller is thrown off and the machine drive is shut off. The few remaining sheets remove the residual varnish from the varnish applicator roller so that when printing is resumed the newly printed sheets do not stick to the varnish applicator roller and the cooperating cylinder.

What is claimed is:

1. A varnishing system for a printing machine having a supply of varnish, at least one varnish applicator roller cooperating with a cylinder, means for transferring varnish from the supply of varnish to the varnish applicator roller, means for feeding sheets to receive varnish transferred from the varnish applicator roller, and means for shutting off the means for feeding the sheets in response to a printing disturbance signal, wherein the improvement comprises, in combination, means for shutting off the means for transferring varnish from the supply of varnish in response to the printing disturbance signal; and time delay means for activating the means for shutting off the means for feeding after a predetermined time delay, said time delay beginning when said means for shutting off the means for transferring varnish shuts off the means for transferring varnish, and said time delay including the time for at least one sheet to be thereafter fed to receive varnish transferred from the varnish applicator roller, so that said sheet thereafter fed removes varnish from the applicator roller to thereby reduce the likelihood of fed sheets becoming stuck to the varnish applicator roller or the cooperating cylinder when printing resumes.

2. The varnishing system as claimed in claim 1, wherein the time delay means includes a digital electronic counter counting once each time a sheet is fed by the means for feeding the sheets, said counter generating a time delay signal a preselectable number of counts after said printing disturbance signal, and said time delay signal activating the means for shutting off the means for feeding, so that a preselectable number of sheets fed after said printing disturbance signal remove varnish from the applicator roller.

3. The varnishing system as claimed in claim 1, wherein said means for feeding sheets receives sheets from a supply of sheets and said printing disturbance signal is responsive to said supply of sheets failing to supply sheets to said means for feeding sheets.

4. The varnishing system as claimed in claim 1, further comprising means for throwing off the varnish applicator roller from the cooperating cylinder in response to the time delay means after the predetermined time delay.

5. The varnishing system as claimed in claim 2, further comprising means for pneumatically disconnecting the varnish applicator roller from the cooperating cylinder when said counter generates said time delay signal.

6. The varnishing system as claimed in claim 2, wherein range of the preselectable number includes at least the number three.

7. A control method for a varnishing system for a sheet-fed printing machine capable of continuous printing, said varnishing system having a supply of varnish, at least one varnish applicator roller cooperating with a cylinder, means for selectively transferring varnish from the supply of varnish to the varnish applicator roller, and means for feeding sheets to receive varnish from the varnish applicator roller, said control method comprising the steps of:

sensing a printing disturbance requiring continuous printing to be interrupted, thereafter preventing the transfer of varnish from the supply of varnish to the varnish applicator roller, thereafter waiting for at least one sheet to be fed to receive varnish from the varnish applicator roller, and thereafter inhibiting the means for feeding sheets to the varnish application cylinder, so that said sheet receiving the varnish from the varnish applicator roller thereby reduces the likelihood of fed sheets becoming stuck to the varnish applicator roller or the cooperating cylinder when continuous printing resumes.

8. The control method as claimed in claim 7, wherein said step of waiting for at least one sheet to be fed comprises the step of counting at least three sheets being fed to receive varnish from the varnish applicator cylinder.

9. The control method as claimed in claim 7, further comprising the step of throwing off the varnish applicator roller from the cooperating cylinder when the means for feeding the sheets is disabled.

10. The control method as claimed in claim 8, further comprising the step of throwing off the varnish applicator roller from the cooperating cylinder after the step of counting said three sheets being fed to receive varnish from the varnish applicator cylinder.

11. A control arrangement in a multi-color rotary printing machine having a varnishing unit for varnishing continuously printed sheets, said varnishing unit having a varnish supply, means for feeding the varnish from the varnish supply to a varnish applicator roller via transfer rollers, and means for feeding sheets to receive varnish from the varnish applicator roller, wherein said improvement comprises an adjustable preselection counter being actuated in response to a printing disturbance signal requiring the discontinuance of continuous printing, said means for feeding the varnish from the varnish supply to the varnish applicator roller via transfer rollers being disabled to stop the feeding of varnish when the preselection counter is actuated, said preselection counter after being actuated counting the number of sheets thereafter fed to receive varnish from the varnish applicator roller, and after counting a preselected number of sheets in excess of two sheets generating a signal to shut off the feeding of sheets, so that the sheets fed after the printing disturbance signal and after inhibiting the transfer of varnish from the varnish supply to the varnish applicator roller remove varnish from the varnish applicator roller to thereby prevent fed sheets becoming stuck to the varnish applicator roller when continuous printing resumes.

12. The control apparatus as claimed in claim 11, wherein the improvement further comprises the varnish applicator roller being pneumatically thrown off from a cooperating cylinder in response to the preselection counter having counted the preselected number of sheets.

* * * * *